US010198983B2

(12) United States Patent
Szymborski

(10) Patent No.: US 10,198,983 B2
(45) Date of Patent: Feb. 5, 2019

(54) APPARATUS FOR DRIVING DISPLAYS

(71) Applicant: E Ink Corporation, Billerica, MA (US)

(72) Inventor: Zdzislaw Jan Szymborski, Charlestown, MA (US)

(73) Assignee: E Ink Corporation, Billerica, MA (US)

( * ) Notice: Subject to any disclaimer, the term of this patent is extended or adjusted under 35 U.S.C. 154(b) by 13 days.

(21) Appl. No.: 15/171,063

(22) Filed: Jun. 2, 2016

(65) Prior Publication Data

US 2016/0358560 A1 Dec. 8, 2016

Related U.S. Application Data

(60) Provisional application No. 62/170,096, filed on Jun. 2, 2015.

(51) Int. Cl.
*G09G 3/20* (2006.01)
*G09G 3/34* (2006.01)

(52) U.S. Cl.
CPC ..... *G09G 3/2003* (2013.01); *G09G 3/3433* (2013.01); *G09G 2300/0871* (2013.01); *G09G 2310/0289* (2013.01); *G09G 2310/061* (2013.01)

(58) Field of Classification Search
CPC ..... G09G 3/344
See application file for complete search history.

(56) References Cited

U.S. PATENT DOCUMENTS

| | | | |
|---|---|---|---|
| 7,170,670 | B2 | 1/2007 | Webber |
| 7,193,625 | B2 | 3/2007 | Danner et al. |
| 7,202,847 | B2 | 4/2007 | Gates |
| 7,355,784 | B2 | 4/2008 | Kim |

(Continued)

FOREIGN PATENT DOCUMENTS

| | | | |
|---|---|---|---|
| JP | H06130916 | A | 5/1994 |
| JP | 2009096213 | A | 5/2009 |

(Continued)

OTHER PUBLICATIONS

Korean Intellectual Property Office; PCT/US2016/035423; International Search Report and Written Opinion; dated Sep. 5, 2016.

(Continued)

*Primary Examiner* — Christopher J Kohlman
(74) *Attorney, Agent, or Firm* — Antranig Baronian

(57) ABSTRACT

An apparatus (100) for use in driving a display, especially a color electrophoretic display comprising frame generating means generating a succession of frame pulses at regular intervals; frame blanking generating means generating a succession of frame blanking pulses at the same intervals; a plurality of input lines each arranged to receive one of a plurality of differing input voltages (Vin1, . . . VinN), all of the same polarity; an output line capable of being connected to a device driver (106); and switching means (102A, . . . 102N) connecting the output line to one of the input lines when no frame blanking pulse is present, the switching means (102A, . . . 102N) being capable of changing the input line to which the output line is connected during successive frame periods, the switching means (102A, . . . 102N) being arranged to drain charge from the output line when a frame blanking pulse is present.

12 Claims, 4 Drawing Sheets

(56) References Cited

U.S. PATENT DOCUMENTS

| | | | | |
|---|---|---|---|---|
| 7,733,335 | B2 | 6/2010 | Zehner et al. | |
| 7,839,381 | B2 | 11/2010 | Zhou | |
| 8,446,358 | B2 | 5/2013 | Sakamoto | |
| 8,704,753 | B2 | 4/2014 | Miyazaki | |
| 8,717,664 | B2 | 5/2014 | Wang | |
| 8,884,681 | B2 | 11/2014 | Huang | |
| 9,170,468 | B2 | 10/2015 | Lin | |
| 9,285,649 | B2 | 3/2016 | Du | |
| 2007/0200874 | A1* | 8/2007 | Amundson | G09G 3/344 345/690 |
| 2008/0043010 | A1 | 2/2008 | Huitema et al. | |
| 2012/0001889 | A1* | 1/2012 | Kimura | G09G 3/344 345/212 |
| 2013/0147744 | A1* | 6/2013 | Kim | G06F 3/0412 345/173 |
| 2014/0009817 | A1 | 1/2014 | Wilcox et al. | |
| 2014/0118324 | A1 | 5/2014 | Chan et al. | |
| 2014/0340430 | A1 | 11/2014 | Telfer | |
| 2014/0340734 | A1 | 11/2014 | Lin | |
| 2014/0340736 | A1 | 11/2014 | Lin | |
| 2015/0103394 | A1 | 4/2015 | Wang | |
| 2016/0085132 | A1 | 3/2016 | Telfer | |

FOREIGN PATENT DOCUMENTS

| | | | |
|---|---|---|---|
| TW | 200847113 | A | 12/2008 |
| WO | 2009096213 | A1 | 8/2009 |

OTHER PUBLICATIONS

European Patent Office, EP Appl. No. 16804391.7, Extended European Search Report, dated Oct. 23, 2018.

* cited by examiner

APPARATUS FOR DRIVING DISPLAYS

REFERENCE TO RELATED APPLICATIONS

This application claims benefit of Application Ser. No. 62/170,096, filed Jun. 2, 2015.

This application is related to copending application Ser. No. 14/277,107, filed May 14, 2014 (Publication No. 2014/0340430), and copending application Ser. No. 14/849,658, filed Sep. 10, 2015 (Publication No. 2016/0085132). The entire contents of these copending applications and of all U.S. patents and published and copending applications mentioned below are herein incorporated by reference.

The entire contents of these patents and copending applications, and of all other U.S. patents and published and copending applications mentioned below, are herein incorporated by reference.

BACKGROUND OF INVENTION

This invention relates to apparatus for driving displays. This apparatus is particularly but not exclusively intended for driving electrophoretic displays, especially colored electrophoretic displays capable of rendering more than two colors using a single layer of electrophoretic material comprising a plurality of colored particles. The term color as used herein includes black and white.

The term gray state is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate gray state would actually be pale blue. Indeed, as already mentioned, the change in optical state may not be a color change at all. The terms black and white may be used hereinafter to refer to the two extreme optical states of a display, and should be understood as normally including extreme optical states which are not strictly black and white, for example the aforementioned white and dark blue states.

The terms bistable and bistability are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called multi-stable rather than bistable, although for convenience the term bistable may be used herein to cover both bistable and multi-stable displays.

The term impulse, when used to refer to driving an electrophoretic display, is used herein to refer to the integral of the applied voltage with respect to time during the period in which the display is driven.

A particle that absorbs, scatters, or reflects light, either in a broad band or at selected wavelengths, is referred to herein as a colored or pigment particle. Various materials other than pigments (in the strict sense of that term as meaning insoluble colored materials) that absorb or reflect light, such as dyes or photonic crystals, etc., may also be used in the electrophoretic media and displays of the present invention.

Most commercial electrophoretic displays are monochrome, typically black and white. However, attempts have recently been made to develop electrophoretic displays which can display more than two colors, and preferably as many as eight colors, at each pixel. See, for example, U.S. Pat. Nos. 8,717,664 and 9,170,468; and US 2014/0313566; US 2014/0340734; US 2014/0340736; and US 2015/0103394; and the aforementioned US 2014/0340430 and US 2016/0085132. Many of these colored electrophoretic displays require the use of more than three voltage levels to drive the display; various displays described in the applications specifically mentioned above require five or seven voltage levels. Some of the aforementioned displays also make use of active matrix displays with front plane switching, in which the voltage on the common front electrode is varied during the driving process. This is in contrast to most prior art monochrome displays which only require the use of three voltage levels, typically −V, 0 and +V, where V is the drive voltage. Because most commercial monochrome displays only require the use of three voltage levels, typically the column (data line) drivers available for use with such displays are only arranged to handle three voltage levels at any one time (i.e., in any one scanning period (frame period) of the display). To avoid the delay and expense of developing custom drivers for colored displays, it is highly desirable to be able the commercial three level drivers to drive colored displays. As described in the aforementioned US 2016/0085132, it is possible to operate a display requiring the use of five, seven or more voltage levels using a driver capable of handling only three voltage levels in any one frame period by careful arrangement of the waveforms to be used in the display, but to do so it is necessary to be able to change the voltages available from the three level driver on a frame-by-frame basis. Although apparatus capable of changing voltages on a frame-by-frame basis can be assembled from conventional electronic control devices, such apparatus would be inconveniently bulky and costly for use with a small electrophoretic display, for example an electronic book (or document) reader, and hence there is a need for compact, inexpensive apparatus for this purpose. The present invention seeks to provide such apparatus.

SUMMARY OF INVENTION

Accordingly, this invention provides an apparatus for use in driving a display, the apparatus comprising:

frame generating means arranged to generate a succession of frame pulses at regular intervals;

frame blanking generating means arranged to generate a succession of frame blanking pulses at the same intervals as the frame pulses;

a plurality of input lines, each input line being arranged to receive one of a plurality of differing input voltages, all the input voltages being of the same polarity;

an output line capable of being connected to a device driver; and switching means arranged to connect the output line to one of the input lines during the portion of each regular interval when a frame blanking pulse is not present, the switching means being capable of changing the input line to which the output line is connected during successive frame period, the switching means being arranged to drain charge from the output line when a frame blanking pulse is present.

In the apparatus of the present invention, the switching means may comprise a plurality of analog switches, one associated with each input line, each analog switch having a first input connected to its associated input line, an output connected to the output line, each analog switch, and a second input arranged to receive an enable signal, one value of the enable signal causing the voltage on the associated input line to be asserted on the output line, and a second value of the enable signal causing the voltage on the output line to decay. The frame blanking interval is desirably sufficiently long to allow the maximum value which can be asserted on the output line to decay below the minimum value which can be asserted on the output line within the frame blanking interval.

In the apparatus of the present invention, at least one analog switch may comprise:

- a first transistor the drain of the which receives the signal from its associated input line;
- a second transistor having a drain connected to the output line;
- a connector interconnected the sources of the first and second transistors;
- an RC circuit connected between the connector and the gates of the first and second transistors;
- first and second resistors arranged in series between the gates of the first and second transistors and ground; and
- a third transistor arranged to receive the enable signal, and connected between ground and between the first and second resistors.

In analog switches of this type intended for use with a negative voltage on its associated input line, the first and second transistors may be N-channel transistors, and the third transistor may have its one of its emitter and collector arranged to receive the enable signal, its base connected to ground and the other of its emitter and collector connected between the first and second resistors. On the other hand, in analog switches of this type intended for use with a positive voltage on its associated input line, the first and second transistors may be P-channel transistors, and the third transistor may have its base arranged to receive the enable signal, and its other two electrodes connected to ground and between the first and second resistors.

This invention extends to a display, especially an electrophoretic display, and especially a color electrophoretic display, comprising an apparatus of the invention.

This invention also provides a method of driving a display, the method comprising:

- generating a succession of frame pulses at regular intervals;
- generating a succession of frame blanking pulses at the same intervals as the frame pulses;
- asserting a plurality of differing input voltages on a plurality of input lines
- providing an output line connected to a device driver;
- connecting the output line to one of the input lines during the portion of each regular interval when a frame blanking pulse is not present;
- draining charge from the output line when a frame blanking pulse is present; and
- connecting the output line to a different one of the input lines after draining charge from the output line and when a frame blanking pulse is no longer present.

In this method, the frame blanking interval is desirably sufficiently long to allow the maximum value which can be asserted on the output line to decay below the minimum value which can be asserted on the output line within the frame blanking interval.

This invention extends to a display, especially an electrophoretic display, and especially a color electrophoretic display, arranged to carry out the method of the invention.

DETAILED DESCRIPTION

In the description below, all pulses have a positive polarity unless otherwise stated. The term "leading edge" refers to the starting edge of a digital pulse; for a positive polarity pulse, the leading edge is its rising edge; for a negative polarity pulse, the leading edge is its falling edge. The term "trailing edge" describes an ending edge of a digital pulse; for a positive polarity pulse, the trailing edge is its falling edge; for a negative polarity pulse, the trailing edge is its rising edge.

As indicated above, the present invention provides an apparatus which enables more than three drive voltages to be used with a trilevel display driver capable of asserting only three voltages in any one frame. The voltage modulation effected by the apparatus of the present invention as applied to thin film transistor (TFT) based display panels (especially electrophoretic display panels) allows power rail switching on a frame-by-frame basis. Multiple power rails of negative and positive voltages will be supplied by power source circuitry of conventional type known in the art, which will therefore not be described in detail. The apparatus of the present invention time multiplexes the positive voltages from the power source circuitry on to a positive device power rail and similarly multiplexes the negative voltages from the power source circuitry on to a negative device power rail.

Figure 1:
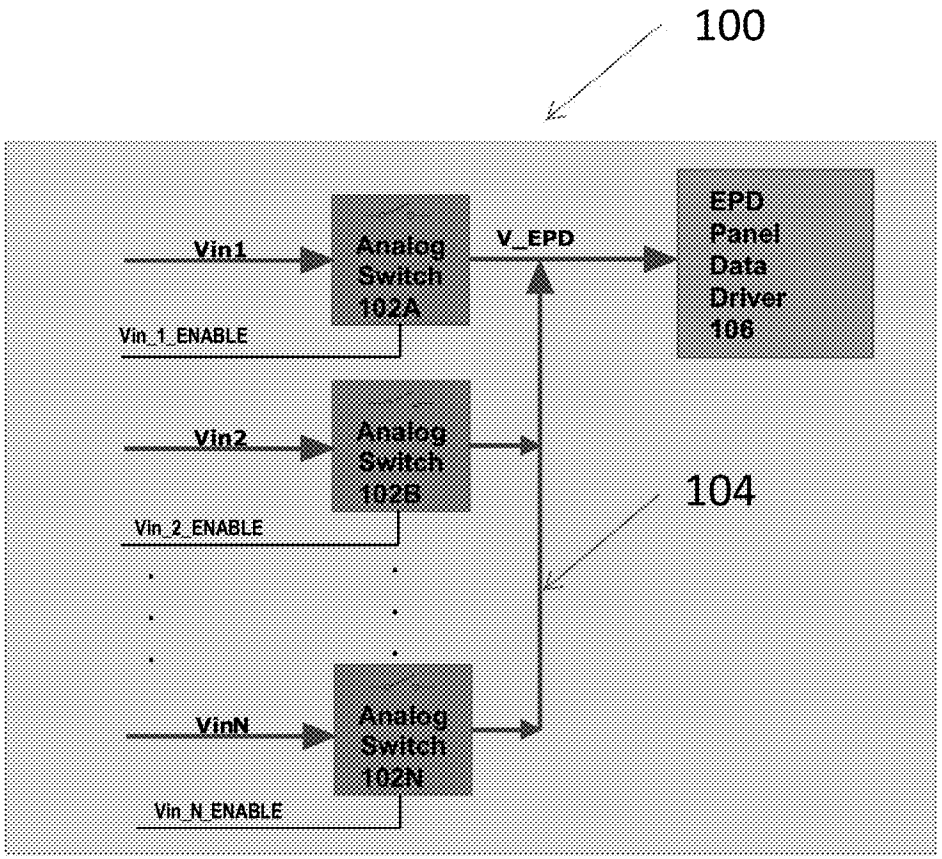
FIG. 1 of the accompanying drawings is a block diagram of an apparatus of the present invention.

FIG. 1 of the accompanying drawings is a block diagram showing a portion of an apparatus of the invention (generally designated 100) for multiplexing a series of positive voltages on to the positive power rail of a display driver. For reasons explained below, a similar apparatus also needs to be provided to effect similar multiplexing of a series of negative voltages on to the negative power rail of the device driver. Also, if front plane switching is to be used, one or two additional units may be required to control the front electrode potential, although in this case the output from the additional unit or units is fed directly to the front electrode itself, rather than to the device driver.

As shown in FIG. 1, the apparatus 100 comprises a series of analog switches 102A, 102B, . . . 102N, each of which is provided with a first input line which receives one of a series of positive voltages Vin1, Vin2, . . . VinN from appropriate power source circuitry (not shown). Each analog switch is also provided with a second input which receives an enable signal Vin_1_ENABLE, Vin_2_ENABLE, . . . Vin_N_ENABLE. A controller (not shown) controls the enable signals such that only one of the analog switches 102A etc. is closed at any one time, so that the one closed switch feeds its positive input voltage to a common output line 104 as voltage V_EPD, and thence to the display driver. The controller varies the enable signals on a frame-by-frame basis so that typically a different voltage appears on output line 104 in each successive frame.

If the apparatus 100 simply switched the voltage on output 104 abruptly from one positive value to another at the beginning of each frame, undesirable voltage surges might result, for example as a result of parasitic capacitances within the display, and it might take some time for the voltage on the output line to settle down to the correct value. In consequence, an incorrect voltage might be applied to pixels during the scanning of the first few lines of the backplane in some frames, with undesirable effects on the electro-optic performance of the display, and/or possible damage to display circuitry or electrodes. To avoid these problems, the apparatus 100 does not simply allow an abrupt change in voltage on the output line 104 but removes charge from this line before asserting a new voltage thereon, as will now be described with reference to FIG. 2.

Figure 2:
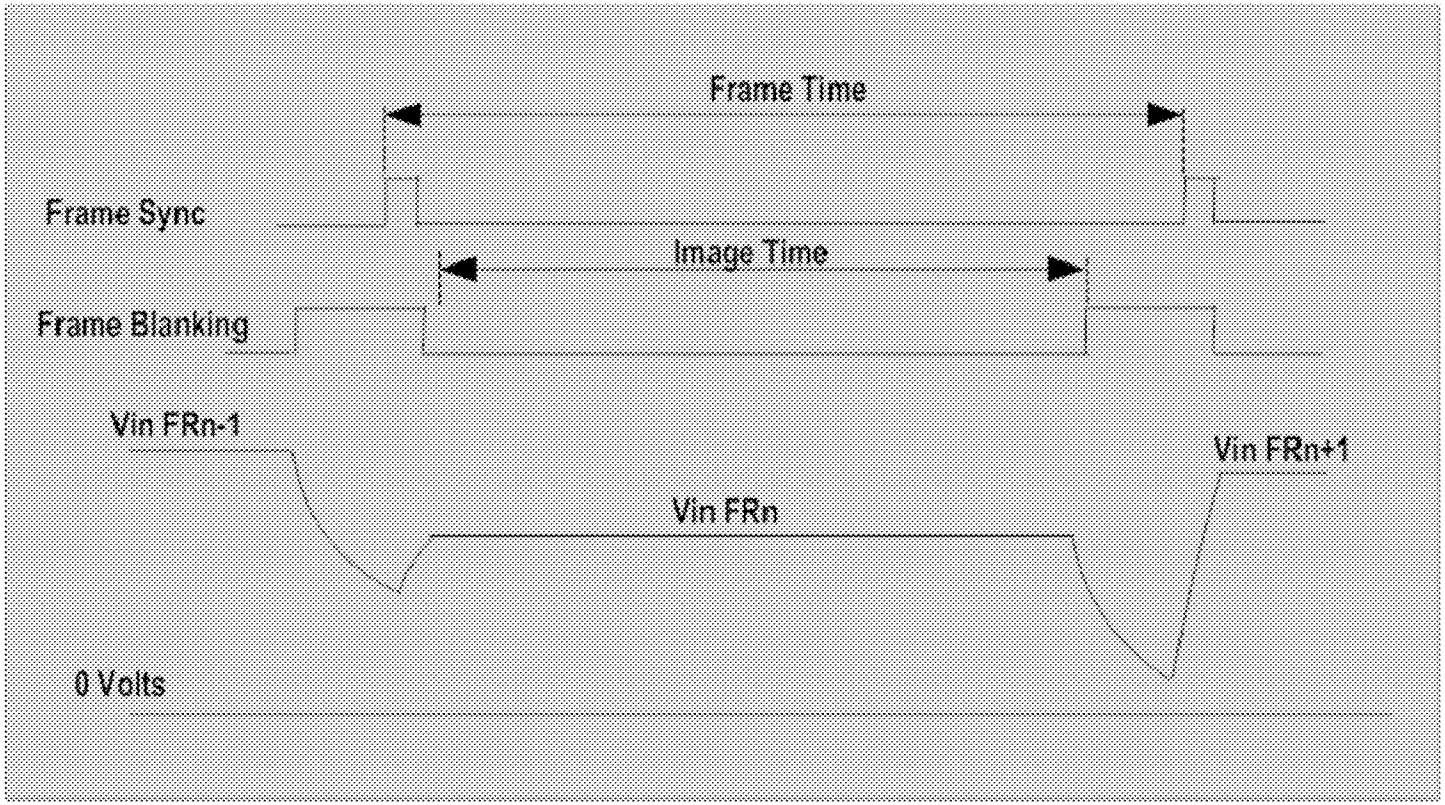
FIG. 2 is a timing diagram showing the timing of various signals present in the apparatus shown in FIG. 1.

As shown in FIG. 2, the apparatus 100 makes use of a frame synchronization signal which comprises a succession of frame pulses at regular intervals corresponding to complete scans of the display. This frame synchronization signal will be familiar to anyone skilled in the technology of electro-optic displays, and need not be generated by the apparatus 100 itself; the signal may, for example, be generated by the device driver and fed back to the apparatus of the invention. The apparatus 100 also makes use of a frame blanking signal which, as shown in FIG. 2, is synchronized with the frame synchronization signal such that each trailing edge of a frame blanking pulse is aligned with the trailing edge of a frame synchronization pulse, However, each frame blanking pulse is longer than a frame synchronization pulse and typically occupies about 2 to about 5 percent of the length of a frame period. (The frame blanking signal is actually the inverse of that shown in FIG. 2; in practice, the frame blanking signal is normally high but goes low when frame blanking is active.)

The lowest trace in FIG. 2 shows the voltages present on the output line 104 during one complete frame, the last part of the preceding frame and the first part of the succeeding frame. As shown in FIG. 2, the voltage on the output line in the preceding frame is constant at Vin FRn−1 until the leading edge of the frame blanking pulse. At this leading edge, the previously closed analog switch supplying Vin FRn−1 to the output line is opened, thus disconnecting this voltage from the output line and device driver power rail. The analog switch, in a manner described below, connects the output line to ground thereby allowing the voltage on the output line to fall exponentially. At the trailing edge of the frame blanking pulse, a different analog switch is closed, so that the voltage on the output line rapidly increases to Vin FRn, and remains at this value until the leading edge of the next frame blanking pulse, when the process is repeated to reach a voltage of Vin FRn+1. Note that the length of the frame blanking pulse must be sufficient to ensure that the voltage present on the output line during one frame will decay to below the value to be placed on the output line during the succeeding frame. To ensure that this is always the case, the frame blanking interval should be sufficiently long to allow the maximum value which can be asserted on the output line to decay below the minimum value which can be asserted on the output line within the frame blanking interval.

Note that actual imaging only takes place during the image time shown in FIG. 2 within the period after the output line has reaching its new desired voltage until the leading edge of the next frame blanking pulse. As will readily be apparent to those skilled in the technology of electro-optic displays, the length of the frame blanking pulse may be varied by controlling the number of "phantom lines" which are provided in the display controller before and/or after the physical lines actually present in an active matrix display.

The sequence shown in FIG. 2 prevents voltages form overlapping. Overlapping of voltage does not allow the device driver power rail to be at the desired voltage until sometime after the overlapping goes away. It also may cause damage to voltage supply circuitry.

Figure 3:
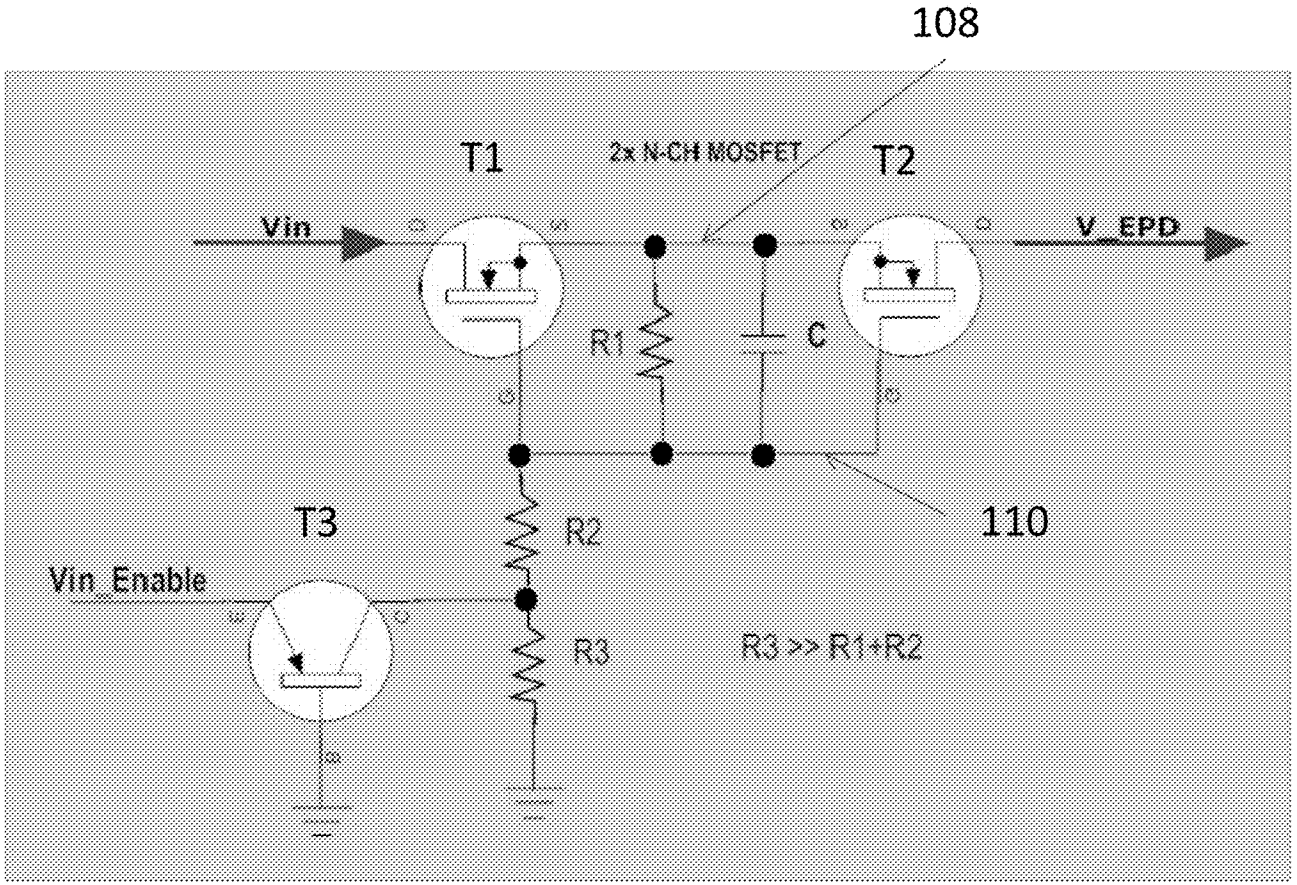
FIG. 3 is a circuit diagram of one form of analog switch which can be employed in the apparatus of FIG. 1 to control negative voltages.

FIG. 3 is a circuit diagram of one of the analog switches 102A, 102B etc. in a version of the apparatus 100 shown in FIG. 1 intended for use with negative voltages. As will be seen from FIG. 3, the first input of the analog switch, carrying (negative) voltage Vin from the power source circuitry is connected to the drain of a first transistor T1. The source of T1 is connected via line 108 to the source of a second transistor T2, the drain of which is connected to the output line carrying V_EPD. T1 and T2 are each N-CH MOSFET transistors. The gates of T1 and T2 are interconnected via a line 110 and a resistor R1 and a capacitor C are connected in parallel between lines 108 and 110 to form an RC circuit. Line 110 is also connected to ground via resistors R2 and R3 arranged in series, where:

$$R3 >> R1 + R2.$$

The second input to the analog switch shown in FIG. 3, carrying enable signal Vin_Enable, is connected to the emitter of a transistor T3, the base of which is connected to ground and the collector of which is connected between resistors R2 and R3.

As will readily be apparent to those skilled in the art, following the trailing edge of a frame blanking pulse, capacitor C allows transistors T1 and T2 to turn on in a time-controlled manner determined by the R2*C time constant. To ensure that transistors T1 and T2 are turned off at the leading edge of a frame blanking pulse, the capacitor C is discharged through R3, thus allowing the exponential decay of the voltage V_EPD.

Figure 4:
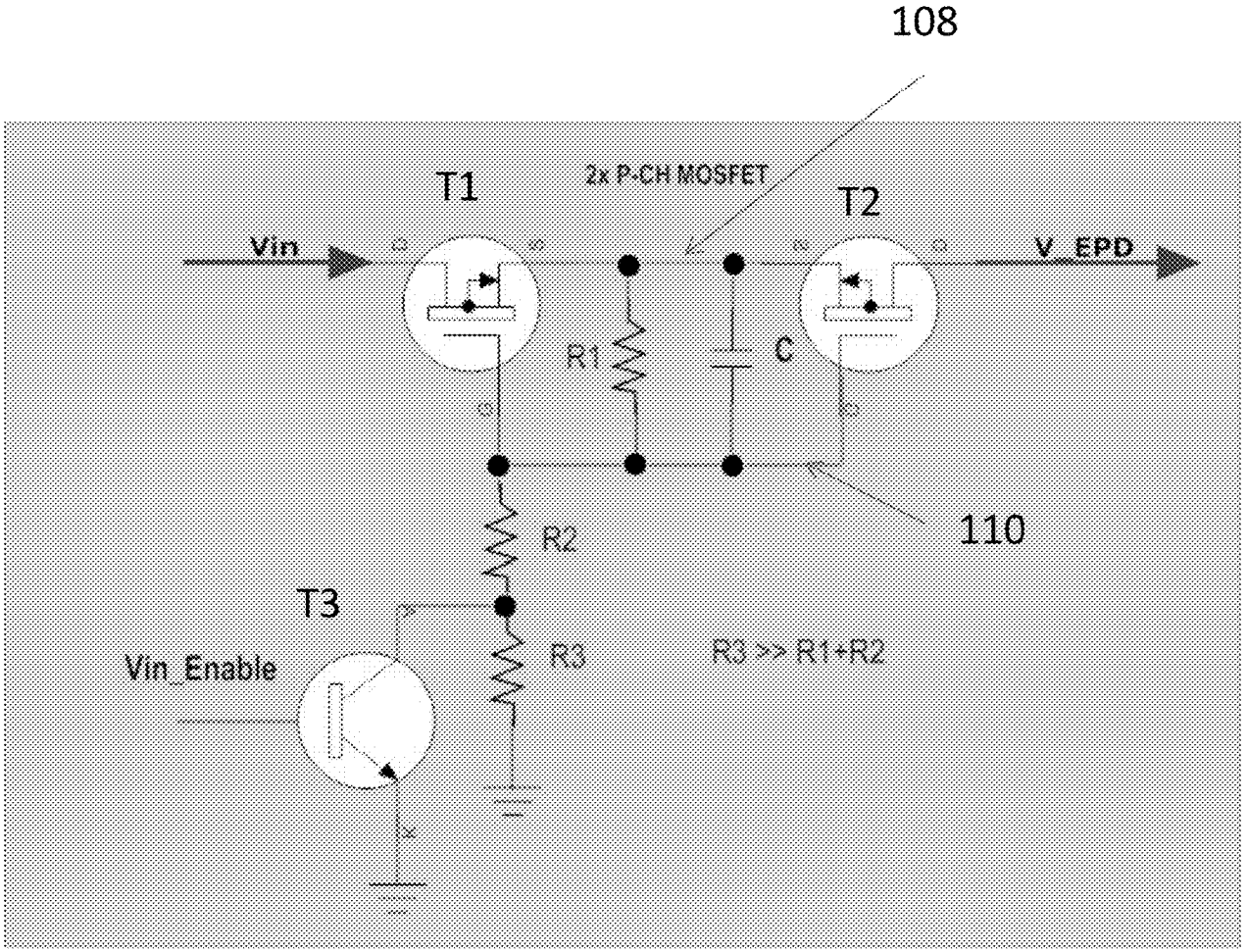
FIG. 4 is a circuit diagram similar to that of FIG. 3 but employed to control positive voltages.

FIG. 4 is a circuit diagram of an analog switch similar to that shown in FIG. 3 but intended for handling positive voltages. The circuit shown in FIG. 4 differs from that shown in FIG. 3 in that:

(a) transistors T1 and T2 are each P-CH MOSFET transistors; and (b) the second input Vin_Enable is connected to the gate of transistor T3, with the other two electrodes of the transistor connected between R2 and R3, and to ground as previously described.

From the foregoing, it will be seen that the present invention can provide compact and inexpensive apparatus for changing the voltages available from the three level driver on a frame-by-frame basis.

It will be apparent to those skilled in the art that numerous changes and modifications can be made in the specific embodiments of the invention described above without departing from the scope of the invention. Accordingly, the whole of the foregoing description is to be interpreted in an illustrative and not in a limitative sense.

The invention claimed is:

1. An apparatus for use in driving a display, the apparatus comprising:

frame generating means arranged to generate a succession of frame pulses at regular intervals;

frame blanking generating means arranged to generate a succession of frame blanking pulses at the same intervals as the frame pulses;

a plurality of input lines, each input line being arranged to receive one of a plurality of differing input voltages;

an output line capable of being connected to a device driver; and switching means arranged to connect the output line to one of the input lines during the portion of each regular interval when a frame blanking pulse is not present, the switching means being capable of changing the input line to which the output line is connected during successive frame periods, the switching means being arranged to connect the output line to ground and drain charge from the output line when a frame blanking pulse is present.

2. An apparatus according to claim 1 wherein the switching means comprises a plurality of analog switches, one associated with each input line, each analog switch having a first input connected to its associated input line, an output connected to the output line, each analog switch, and a second input arranged to receive an enable signal, one value of the enable signal causing the voltage on the associated input line to be asserted on the output line, and a second value of the enable signal causing the voltage on the output line to decay.

3. An apparatus according to claim 2 wherein at least one analog switch comprises:

a first transistor the drain of the which receives the signal from its associated input line;

a second transistor having a drain connected to the output line;

a connector interconnected the sources of the first and second transistors;

an RC circuit connected between the connector and the gates of the first and second transistors;

first and second resistors arranged in series between the gates of the first and second transistors and ground; and a third transistor arranged to receive the enable signal, and connected between ground and between the first and second resistors.

4. An apparatus according to claim 3 having a negative voltage on its associated input line, wherein the first and second transistors are N-channel transistors, and the third transistor has its one of its emitter and collector arranged to receive the enable signal, its base connected to ground and the other of its emitter and collector connected between the first and second resistors.

5. An apparatus according to claim 3 having a positive voltage on its associated input line, wherein the first and second transistors are P-channel transistors, and the third transistor has its base arranged to receive the enable signal, and its other two electrodes connected to ground and between the first and second resistors.

6. An apparatus according to claim 1 wherein the frame blanking interval is sufficiently long to allow the maximum value which can be asserted on the output line to decay below the minimum value which can be asserted on the output line within the frame blanking interval.

7. An electrophoretic display comprising an apparatus according to claim 1.

8. An electrophoretic display according to claim 7 which is a color electrophoretic display.

9. A method of driving a display, the method comprising:

generating a succession of frame pulses at regular intervals;

generating a succession of frame blanking pulses at the same intervals as the frame pulses;

asserting a plurality of differing input voltages on a plurality of input lines providing an output line connected to a device driver;

connecting the output line to one of the input lines during the portion of each regular interval when a frame blanking pulse is not present;

connecting the output line to ground and draining charge from the output line when a frame blanking pulse is present; and connecting the output line to a different one of the input lines after draining charge from the output line and when a frame blanking pulse is no longer present.

10. A method according to claim 9 wherein the frame blanking interval is sufficiently long to allow the maximum value which can be asserted on the output line to decay below the minimum value which can be asserted on the output line within the frame blanking interval.

11. An electrophoretic display arranged to carry out the method of claim 9.

12. An electrophoretic display according to claim 11 which is a color electrophoretic display.

* * * * *